United States Patent [19]

Petersen

[11] Patent Number: 4,558,647

[45] Date of Patent: Dec. 17, 1985

[54] MODULAR SHELVING

[75] Inventor: Svend Petersen, 2425 Lucknow Dr., Mississauga, Ontario, Canada, L5S 1H1

[73] Assignee: Svend Petersen, Toronto, Canada

[21] Appl. No.: 528,547

[22] Filed: Sep. 1, 1983

[51] Int. Cl.[4] ..... A47B 57/14; A47B 55/02

[52] U.S. Cl. ..... 108/107; 108/111; 211/181

[58] Field of Search ..... 108/107, 110, 111, 108, 108/109, 106, 144, 156; 211/181, 106, 187

[56] References Cited

U.S. PATENT DOCUMENTS

| | | | |
|---|---|---|---|
| 2,562,497 | 7/1951 | Klein | 108/107 |
| 2,850,172 | 9/1958 | Beckner | 211/181 |
| 3,091,345 | 5/1963 | Hoose et al. | 108/111 |
| 3,101,148 | 8/1963 | Brown | 211/181 |
| 3,146,734 | 9/1964 | Kesilman et al. | 108/111 |
| 3,696,763 | 10/1972 | Evans | 108/111 |
| 3,705,654 | 12/1972 | Barrineau, III | 108/110 |
| 3,967,327 | 7/1976 | Severson | 108/111 |
| 4,044,448 | 8/1977 | Watanabe et al. | 108/111 |
| 4,231,301 | 11/1980 | Barrineau, III | 108/110 |
| 4,292,902 | 10/1981 | Barrineau | 108/110 |

FOREIGN PATENT DOCUMENTS

| | | | |
|---|---|---|---|
| 212321 | 1/1958 | Australia | 108/107 |
| 1459574 | 11/1966 | France | 108/111 |
| 560631 | 4/1975 | Switzerland | 108/107 |

*Primary Examiner*—William E. Lyddane
*Assistant Examiner*—Mark W. Binder
*Attorney, Agent, or Firm*—Ridout & Maybee

[57] ABSTRACT

The invention provides a modular shelving unit comprising at least two upright members and at least two shelf elements which engage oppositely spaced upright members to form a shelving structure. The component upright members and shelf elements are made of a latticework, preferably of welded wire, which is secured at two opposite edges in support beams. The support beams of the upright members provide vertical structure for the unit, and the support beams of the shelf elements provide structure therefor and means for connecting the shelf elements to the upright elements.

12 Claims, 7 Drawing Figures

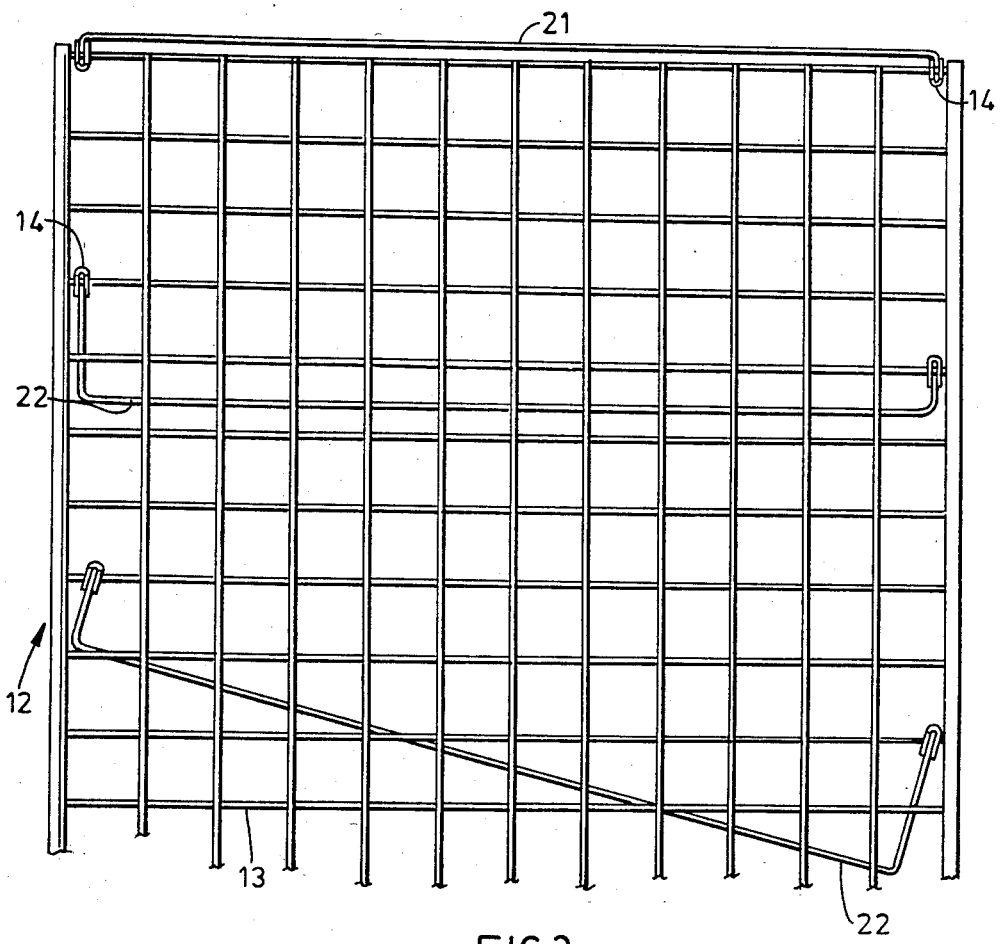
FIG.3
FIG. 6
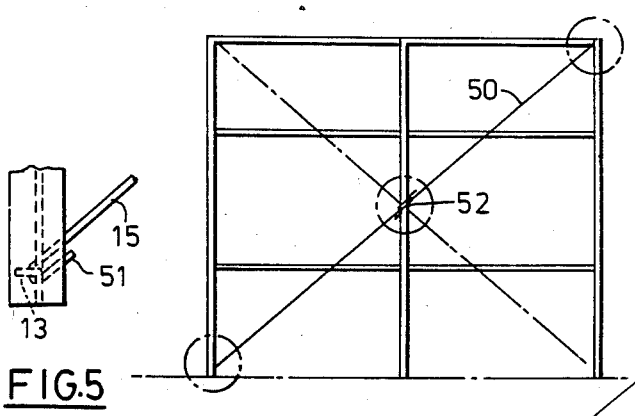
FIG.4
FIG.5
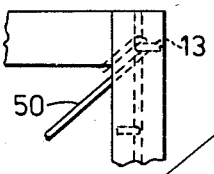
FIG.7
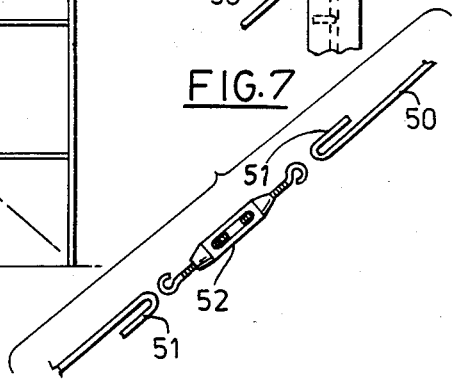

MODULAR SHELVING

The present invention relates to a modular shelving system. Conventional modular shelving units usually require the use of fasteners for assembly and often have solid planar surfaces which collect dirt and impair visibility and air circulation.

The present shelving unit makes use of welded wire latticeworks fixed in support beams to provide a strong storage system for lightweight articles which is simple to assemble without the need for fasteners or tools. The latticework structure of the invention allows for adequate illumination and therefore, good visibility of the stored articles, even those articles located on the bottom shelves. In relation to fire safety, the open construction of the present shelving ensures good air circulation and optimum sprinkler coverage to the stored articles.

The shelving of the invention can be erected in a restricted space and the component shelf elements may be adjusted individually without disturbing adjacent elements. Different types of shelf elements may be installed on the same unit, and all shelf elements may be provided with auxiliary support beams positioned underneath to give additional support for heavier items.

The various components of the present modular shelving are themselves lightweight and may be nested for easy packing, storage and handling.

Accordingly, the present invention provides a modular shelving unit comprising at least two upright members to which are connected at least two shelf elements to form a shelf structure. The upright members are made of a latticework which is fixed along two opposite edges thereof in support beams which provide the upright structural components for the unit. The shelf elements also are made of a latticework fixed along two opposite edges thereof in support beams. The support beams of the shelf elements have means at each end thereof for engaging the latticework of an upright member.

A preferred embodiment of the invention will be described hereinafter with reference to the drawings in which:

FIG. 3 is a partial end view of a shelving unit showing several possible configurations for various shelf elements; and FIGS. 4 through 7 show various details of an optional bracing which may be applied across the back of a unit.

Figure 1:
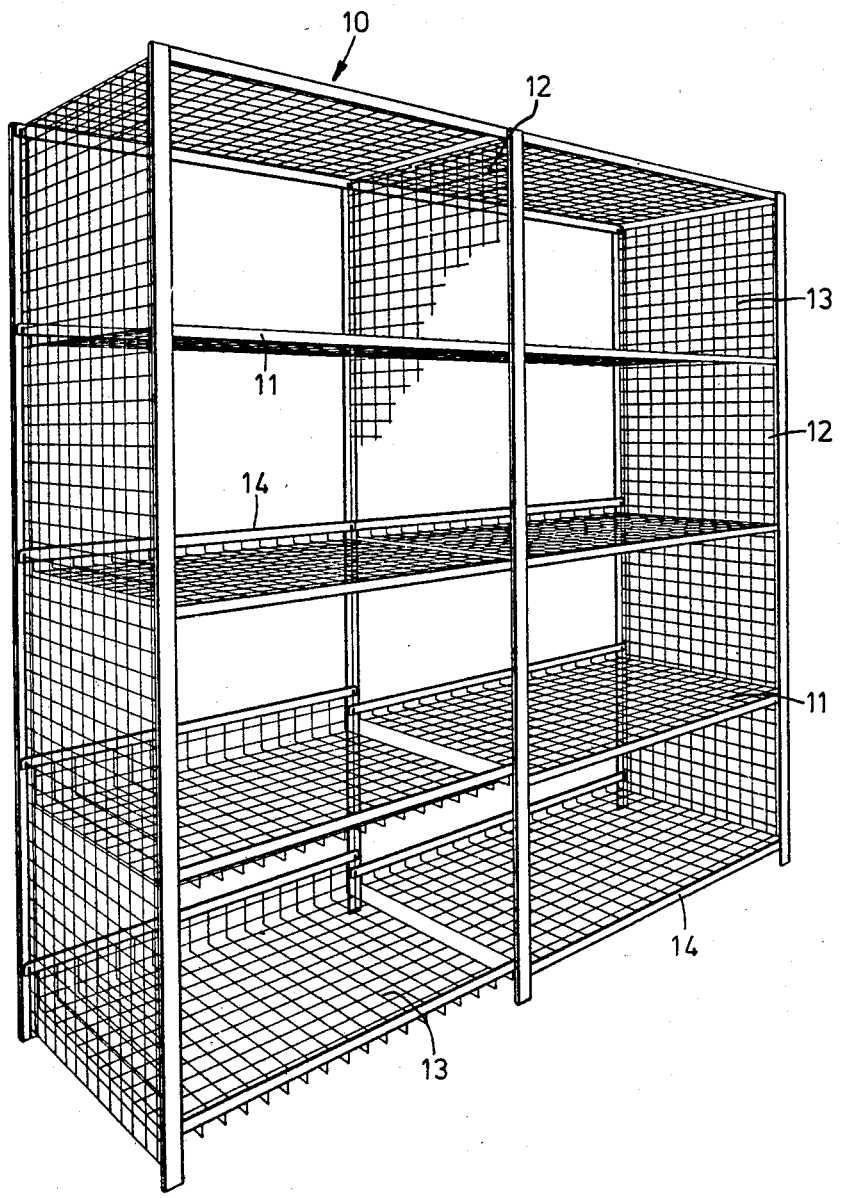
FIG. 1 is a perspective view partially cut away of a double selving unit showing several types of shelf elements.

Referring to FIG. 1, the present invention provides a modular shelving unit 10 comprising shelf elements 11 engaging oppositely spaced upright members 12 to form the shelf structure. FIG. 1 illustrates a double unit, and additional units 10 may be added at either end upright member 12 as desired.

The shelf elements 11 and upright members 12 are preferably made of a latticework 13 comprising welded steel wire of sufficient diameter to provide a strong and durable structure to the components. It has been found that 10 gauge steel wire, i.e. wire having a diameter of 0.135 inch, is suitable for the purposes of the invention. The latticework 13 should be of a mesh size to give adequate strength to the structure as well as allowing for good visibility of the shelving contents and the other aforementioned advantages inherent in an open structure. Accordingly, the preferred mesh size of the latticework 13 is 2 inches by 2 inches.

Figure 2:
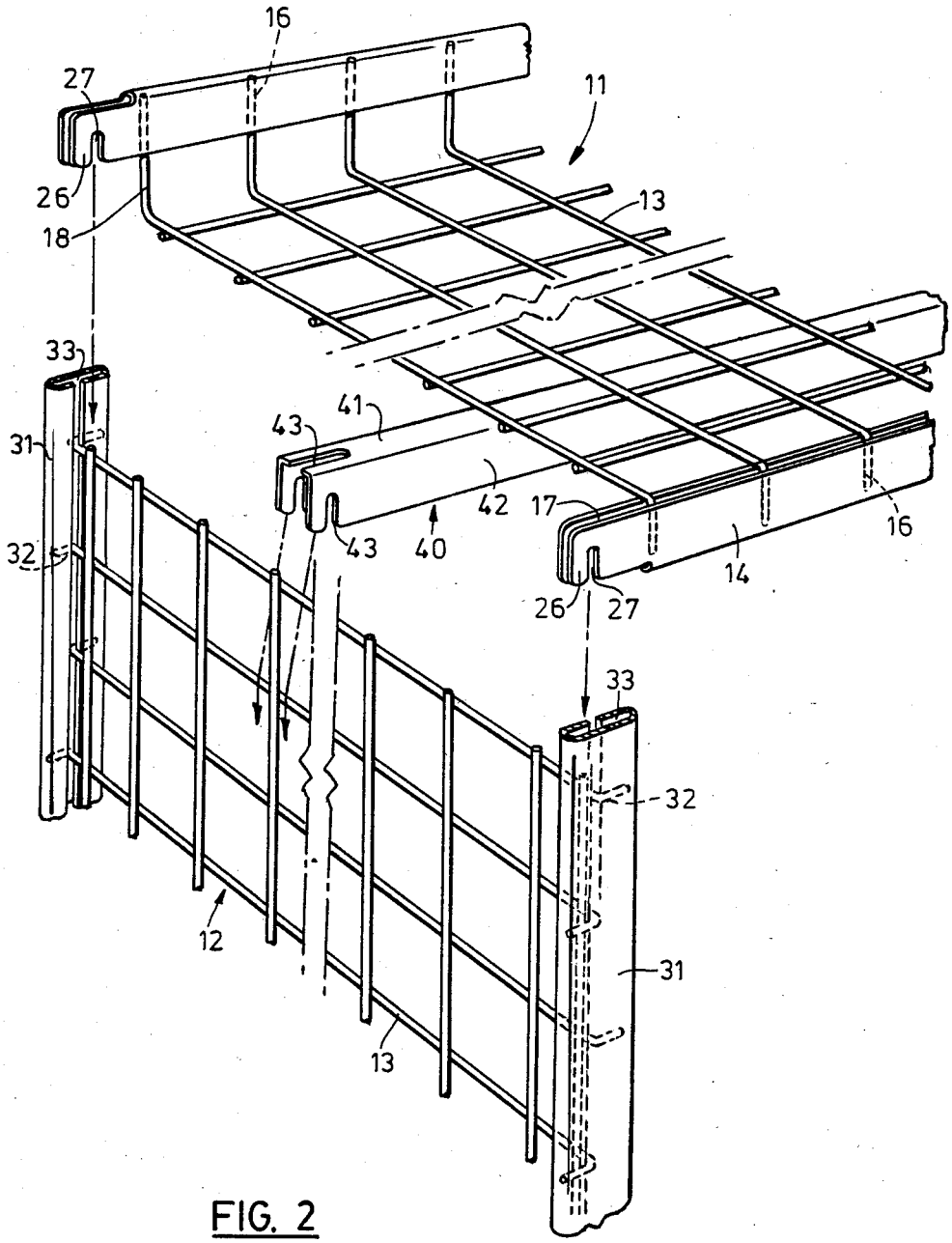
FIG. 2 is a perspective view of a detail showing the manner of construction and assembly of the preferred shelf unit.

The latticework 13 of the shelf elements 11 is provided with additional structure and rigidity by means of support beams 14 fixed along prongs of opposite edges 16 thereof (FIG. 2). Each support beam 14 is made of sheet metal which is bent to provide a U-shaped channel 17 along its length to receive the edge prongs 16 of the latticework 13. The beam 14 is preferably 16 gauge steel and the edge prongs 16 of the latticework 13 are welded in place in the beam channel 17.

As shown in FIG. 2 the edge prongs 16 of the latticework 13 may be received in an upward or downward opening channel 17 of the beam 14 depending on the type of shelf element 11 being made. The shelf element 11 shown in FIG. 2 has a raised rear side 18 to inhibit spillage from the rear of the shelf by the pressure of articles added at the front thereof. Alternatively, FIG. 3 shows a flat shelf element 21 and two configurations for a bin shelf element 22. While these are three preferred configurations for the shelf elements 11, other configurations of the invention should be apparent to the reader skilled in the art.

The support beams 14 of the shelf elements 11 are provided at each end thereof with means for engaging the upright members 12 so as to form the shelf structure. The preferred means to effect such engagement comprises a hook 26 at each end of each beam 14 for engaging a horizontal wire of the latticework 13 of an upright member 12. The hook 26 can simply be formed by providing a slot 27 across the end portion of the beam 14 as shown in FIG. 2. By cutting away the bent portion of the beam 14 at either end thereof about the hook 26, each hook 26 can also engage a vertical wire of the latticework so that the shelf 11 is supported in a direct manner by the welds at the intersection of the vertical and horizontal wires engaged by each hook 26.

The latticework 13 of the upright members 12 is also provided with support beams 31 as shown in FIG. 2. Each beam 31 gives additional structure and rigidity to the upright members 12 by securing the opposing vertical edge prongs 32 of the latticework 13 therein. Preferably, the beams 31 are formed from sheet metal, and in this regard, 16 gauge sheet steel has been found to be quite suitable. The beams 31 are formed to have a channel of C-shaped cross section 33 so that the prongs of the edges 32 of the latticework 13 can be bent at alternating right angles for insertion in the channel 33. The prongs of the edges 32 need not be welded in place in the channel 33. It has been found that sufficient strength for the upright member structure 12 is obtained by swaging the prongs of the edge 32 in the channel 33 of the beam 31 by means of a press brake.

Assembly of the shelving unit 10 is simply accomplished by hooking at least two shelf elements 11 to oppositely spaced apart upright members 12 to give a structure having adequate stability. Of course additional shelf elements 11 may be added, and the shelving may be expanded by adding further units comprising shelf elements 11 and upright members 12 to either end of the basic unit 10. The dimensions of the shelf elements 11 and upright members 12 can be varied to meet most storage requirements. Shelf elements 11 are preferred in sizes from 12×36 inches to 36×48 inches, and upright members 12 are preferred in sizes from 12×75 inches to 36×123 inches.

When using shelf elements 11 of the larger sizes, or when extra support is needed for storing heavier articles, auxiliary support beams 40 may be used. As shown in FIG. 2 an auxiliary support beam 40 may be positioned under a shelf element 11 for this purpose. The auxiliary beam 40 is preferably made of 16 gauge sheet steel longitudinally bent at right angles to give a flat upper support surface 41 and two downward depending sides 42. At each end of the auxiliary beam 40 notches 43 are provided in the surface 41 and sides 42 to allow the end of the beam 40 to engage the horizontal and vertical wires of the latticework 13 of the upright members 12. This two-way engagement of the beam 40 with the latticework 13 prevents the beam 40 from shifting, and allows the beam 40 to be supported directly by the welds at the intersection of the horizontal and vertical wires engaged by the end notches 43.

When additional bracing is required, the latticework structure of the upright members 12 allows for the simple addition of suitable gauge wiring diagonally across the rear of a single or double unit. As shown in FIGS. 4 through 7, wire bracing 50 having hooked ends 51 can engage the latticework 13 and a turnbuckle 52. The bracing wires 50 can then be tensioned by means of the turnbuckle 52 to provide added structural integrity to the shelving.

I claim:

1. A modular shelving unit comprising:

at least two upright members, each member comprising a latticework having prongs along two opposing edges thereof, said prongs being alternately bent at approximately right angles to the plane of the latticework, and a first support beam for each edge of the latticework having bent prongs, each said first beam being formed to define a longitudinal channel of C-shaped cross section so that the bent edge prongs of the latticework may be inserted and fixed within said longitudinal channel, said first support beams providing upright structural components for the unit; and at least two shelf elements, each element comprising a latticework having prongs along two opposing edges thereof, and a second support beam for each latticework edge having prongs, each said second beam being formed to define a longitudinal channel of U-shaped cross section so that the edge prongs of the latticework may be inserted and fixed within said channel, said second beams having means at each end for engaging the latticework of an upright member, said shelf elements being engagable with oppositely spaced upright members to form a shelving unit.

2. A shelving unit as claimed in claim 1, wherein the latticework of the upright members and shelf elements is formed of metal wires welded at right angles.

3. A shelving unit as claimed in claim 2, wherein the wire is steel having a diameter of 0.135 inch and the mesh size of the latticework is 2 inches by 2 inches in both the upright members and shelf elements.

4. A shelving unit as claimed in claim 2, wherein the first and second support beams are formed of steel sheet metal.

5. A shelving unit as claimed in claim 4, wherein the first support beams are made of 16 gauge sheet metal.

6. A shelving unit as claimed in claim 4, wherein the second support beams are made of 16 gauge sheet metal.

7. A shelving unit as claimed in claim 4, wherein the means at each end of each second support beam comprises at least one hook for engaging a wire of a latticework of an upright member.

8. A shelving unit as claimed in claim 1, further comprising at least one auxiliary support beam positioned under a shelf element providing additional support therefor, said auxiliary beam having means at each end for engaging the latticework of an upright member.

9. A shelving unit as claimed in claim 8, wherein the auxiliary support beam is formed of sheet steel and the means at each end thereof comprises at least one hook.

10. A shelving unit as claimed in claim 1, further comprising wire bracing tensionable by means of a turnbuckle, said bracing running diagonally across the back of the shelving unit.

11. A shelving unit as claimed in claim 4, wherein the edges of the latticework of each shelf element are welded in said second support beams.

12. A shelving unit as claimed in claim 1, wherein the shelf element comprises one or more raised sides.

* * * * *